United States Patent [19]

Rammler et al.

[11] 4,002,534

[45] Jan. 11, 1977

[54] CONTINUOUS COKING PROCESS

[75] Inventors: Roland Rammler, Konigstein, Taunus; Paul Lange, Frankfurt am Main, both of Germany

[73] Assignee: Metallgesellschaft Aktiengesellschaft, Frankfurt am Main, Germany

[22] Filed: July 23, 1974

[21] Appl. No.: 491,029

Related U.S. Application Data

[63] Continuation of Ser. No. 278,679, Aug. 7, 1972, abandoned.

[30] Foreign Application Priority Data

Aug. 20, 1971 Germany ..... 2141876

[52] U.S. Cl. ..... 201/6; 201/15; 201/25; 201/27; 201/34; 201/37; 44/10 C

[51] Int. Cl.[2] ..... C10B 53/08; C10B 47/20; C10B 51/00

[58] Field of Search ..... 201/15, 27, 29, 34, 201/36, 37, 38, 43, 6, 25; 44/1 R, 1 F, 10 C, 10 K, 40; 75/42

[56] References Cited

UNITED STATES PATENTS

| | | | |
|---|---|---|---|
| 1,830,884 | 11/1931 | Neilsen et al. | 201/43 |
| 2,131,702 | 9/1938 | Berry | 201/43 |
| 2,955,988 | 10/1960 | Sebastian | 201/43 |
| 3,671,402 | 6/1972 | Wenzel et al. | 201/27 |
| 3,705,086 | 12/1972 | Schmalfeld et al. | 201/36 |

*Primary Examiner*—Hiram H. Bernstein
*Attorney, Agent, or Firm*—Burgess, Dinklage & Sprung

[57] ABSTRACT

Lump fuels are continuously coked at a high temperature above 750° C in a shaft oven with direct heating by a hot scavenging gas which is produced by a partial combustion of the coking gas and conducted through the shaft oven in a countercurrent to the lump fuel. A reactive carbonaceous material is added to the hot scavenging gas before it enters the high-temperature coking zone and reacts with the gasifying agents (carbon dioxide and water) contained therein before it is introduced into the shaft oven.

9 Claims, 1 Drawing Figure

1
2
3
4
5
6
7
8
9
10
11
12
13
14
15
16
17
CH4
CH4
CH4

CONTINUOUS COKING PROCESS

This is a continuation of application Ser. No. 278,679, filed Aug. 7, 1972 and now abandoned.

BACKGROUND

This invention relates to a process of coking lump fuel at high temperatures in shaft ovens which are heated only with hot scavenging gases which have been produced in a combustion chamber and are conducted through the coking zone in a counter-current to the lump fuel.

The degasification of fuel with scavenging gases has found a wide application in the production of low-temperature tar. This dry distillation using a scavenging gas is carried out at low or medium temperatures of about 450° – 650° C. and results in a high yield of tar and in a coke having a relatively high content of volatile constituents. The hot scavenging gas is produced from the gas produced by dry distillation in that part of the latter gas is burned when tar and water have been removed by condensation. By this treatment, the $CO_2$ and water vapor contents of the scavenging gas are increased.

Difficulties are involved in this operation if the coking temperature is to be increased above 750° – 800° C. At these temperatures, carbon dioxide and water vapor react with solid carbon to form CO and $H_2$. These known endothermic gasification reactions take place at such a high rate that the temperature of the lump of coke is appreciably reduced. As a result, there is a difference between the temperature of the scavenging gases entering the coking zone and the final temperature of the coking treatment. The decrease of the temperature of the scavenging gas is due to the heat requirement of the undesired endothermic gasification reactions.

An increase of the inlet temperature of the scavenging gas intensifies mainly the endothermic gasification reactions and has only a very small influence on the coking temperature.

The degree of decomposition of the gasifying agents depends not only on the operating conditions, particularly on the temperature of the scavenging gas, but also on the reactivity of the solid fuel. An indirect measure of this influence is the residual content of volatile constituents remaining in the coke. For instance, if lignite briquettes are coked to form a highly reactive coke, the content of volatile constituents in the coke can hardly be decreased below 4% if scavenging gases are used which contain $CO_2$ and $H_2O$. On the other hand, the content of volatile constituents may well be decreased to 1.2 – 1.5% in coke which has a low reactivity, such as is produced, e.g., by the degasification of anthracite briquettes. As regards the final temperature of the coking process, the gasification reactions might be tolerated, particularly with fuels having a low reactivity, but these reactions result in two additional serious disadvantages. One of these is the decrease of the yield of coke by 1 – 6%, depending on the operating conditions. The other disadvantage is more significant and resides in the weakening of the coke structure.

These gasification reactions do not only take place on the external surface of the lump of fuel but also on its internal surfaces so that not only the abrasion resistance of the coke but its mechanical strength as a whole is reduced. This results, e.g., in a lower crushing strength and in lower stability and hardness values according to ASTM. The gasification results in such a deterioration of the coke that the product of the process may no longer be satisfactory if a high-strength coke is required. For this reason, the coking with scavenging gases at high temperature has not been successful so far in spite of its numerous advantages.

To avoid the disadvantages, it has already been proposed to heat the scavenging gases not directly by a partial combustion but indirectly in recuperators. In this way, the combustion products may be kept from the scavenging gas. Owing to the high temperatures, however, the recuperators become very expensive. Besides, cracked products deposited on the pipe surfaces give rise to trouble in operation.

In another process, the scavenging gases may be heated in regenerators heated in alternation. This concept has proved to be practicable in pilot plant operations but is too expensive and for this reason has not been used in practice.

DOS 1,471,588 describes a process of continuously coking fine-grained coal in a gas stream. In that process, the fine-grained coal is centrally and axially blown into a cylindrical degasification chamber and a highly preheated carrier gas is blown in tangentially to the coal at the roof of the jet of fine-grained coal. That carrier gas is a hot combustion gas, which after an addition of steam is subjected to a water gas reaction in a chamber which is filled with lump coke so that also surplus oxygen is consumed. The presence of $CO_2$ in the carrier gas is not taken into account. The process is intended for use in the coking of fine-grained fuels.

German Pat. No. 369,885 describes a process of improving the calorific value and of increasing the yield of a gas produced by dry distillation. Oil is injected into the hot scavenging gases between the combustion chamber and the kiln. This carbonization results at the same time in a reduction of the scavenging gas temperature. Because that process is intended for the low temperature carbonisation of fuels, the above-described gasification reactions have not been taken into account because they may be neglected in the low temperature range.

SUMMARY

It is an object of the invention to convert lump fuel by means of highly heated scavenging gases into lump coke having a high mechanical strength and to avoid during the coking treatment particularly the detrimental endothermic gasification reactions which are caused by the $CO_2$ and water vapor contained in the scavenging gas and attack the structure of the coke.

This object is accomplished according to the invention in that fuel dust and/or high-hydrocarbon gases are added to the heated scavenging gas before it enters the high-temperature coking zone and are caused to react with the gasifying agents contained in the scavenging gas before the latter is introduced into the coking zone so that the coking is effected at a high temperature.

It has now been found that the gasification potential represented by the $CO_2$ and $H_2O$ contents of the scavenging gas need not be entirely consumed before the scavenging gas enters the coke charge. A detrimental action on the coke will be prevented if said potential is substantially consumed. This consumption of the gasification potential is accomplished in that reactive carbonaceous materials with which the gasifying agents can react are introduced into the scavenging gases in a pregasification passage which precedes the oven. As a result, the gasification potential is reduced before the scavenging gases contact the coke in the coking shaft. The reactions need not proceed until a complete equilibrium is reached. The endothermic gasification reactions taking place in the pregasification passage reduce the temperature of the scavenging gas. Before being fed with the carbonaceous material, the scavenging gas must be at a temperature which exceeds the required coking temperature by an amount corresponding to the temperature drop in the pregasification passage.

DESCRIPTION OF THE DRAWING

The process is shown diagrammatically and by way of example in FIG. 1.

From a bin 1 for lump fuel, the fuel is charged into the shaft oven having a coking zone 2. The fuel is subsequently cooled in a coke-cooling zone 3 and thereafter withdrawn.

Figure 1:
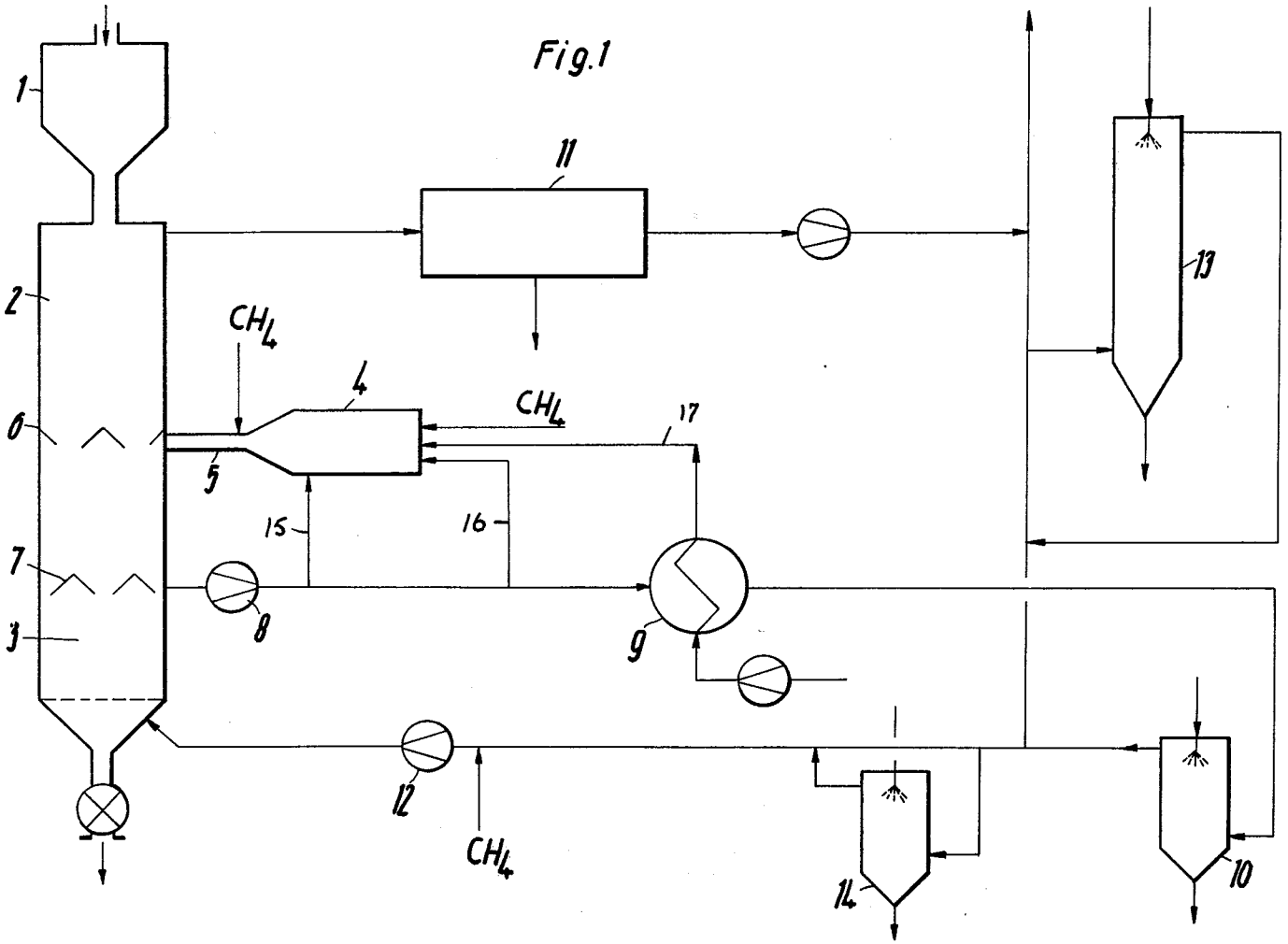

A hot gas is produced in a combustion chamber 4 and reacts with carbonaceous material fed into a hot gas conduit 5 and is introduced into the shaft oven as a scavenging gas through a series of rooflike inlets 6. To produce the hot gas, heated gas is withdrawn from the coke-cooling zone through a series of rooflike outlets 7 by means of a blower 8. A partial stream of that gas is conducted into the combustion chamber 4. Another partial stream is cooled in a heat exchanger 9, and the heat is used to preheat the combustion air for the combustion chamber 4. The cooling gas leaving the air preheater 9 is cooled further in a scrubber 10 and is combined with a partial stream of the coking gas from a condensing plant 11 and by means of a blower 12 is returned into the coke-cooling zone 3 of the shaft oven. The coking gas from the condensing plant 11 may be conducted through a scrubber 13 to remove carbon dioxide. The combined gas streams for the coke-cooling zone may also be conducted through an additional scrubber 14 to provide a gas having a greatly reduced dew point.

The invention will now be explained more fully with reference to an example and to the diagrammatic FIG. 1. The fuel briquettes are fed from the bin 1 into the coking zone 2 of the shaft oven, in which they are heated to 870° C., and finally travel through the coke-cooling zone 3, from which they are withdrawn as a finished product at 150° C. The oven is heated with scavenging gases which are at a temperature of 1000° C. and which are made in the combustion chamber 4 and through the hot gas conduit 5 and the rooflike inlets 6 enter the fuel charge, which slowly descends in the shaft. The scavenging gas is produced from gas which is at a temperature of 500° C, and which is withdrawn from the coke-cooling zone 3 through the rooflike outlets 7 by a blower 8. Part of the gas from 8 is fed through line 15 to chamber 4 and is burned as burner together with preheated air from the heat exchanger 9 via line 17. Another part of the gas is introduced via line 16 as recycle gas into the rear portion of the combustion chamber 4 to control the hot gas temperature. In the present example the remaining hot cooling gas from 8 is used to preheat the air in heat exchanger 9. In this way, a large part of the sensible heat of the resulting coke is utilized in the coking process.

The cooling gas which has left the air preheater 9 is cooled in the scrubber 10. Coking gas which is at 35° C. and comes from the condensing plant 11 is then added to the cooled cooling gas from 10 and is subsequently recycled to the coke-cooling zone 3 by the blower 12. The rate at which coking gas is added from the condensing plant 11 to the cooling gas from 10 is suitably selected to correspond to the rate at which coking gas is withdrawn from the cycle via 8 to produce the scavenging gas in chamber 4.

The hot scavenging gas contains gasifying agents in the form of $CO_2$ and steam, which are introduced in part by the coking gas withdrawn from the condensing plant 11 and in part are produced by the combustion in the combustion chamber 4. If the scavenging gas at 1000° C. is directly introduced into the shaft, the scavenging gas will be cooled and part of the coke will be consumed by gasification reactions so that the strength of the coke is reduced. In one embodiment of the invention, fuel dust collected from the hot coking gas is introduced at the inlet of the hot gas conduit 5 into the heated scavenging gas. To eliminate the gasification potential, dust must be introduced in an amount corresponding to 0.5 – 3% of the coke throughput. Part of this dust reacts with the gasifying agents during the travel to the rooflike inlets 6 for the hot gas, so that the latter is cooled to 900° C. and the gasification which would adversely affect the strength of the coke is anticipated.

According to another embodiment of the invention, additional natural gas ($CH_4$) is blown into the combustion chamber 4. This additional natural gas is partly cracked to form carbon black, part of which reacts with the gasifying agents. Good results will also be obtained if the natural gas ($CH_4$) is added to the process at different locations, e.g., at the inlet of the hot gas conduit 5 or before the cooling gas blower 12.

The flow rate of the natural gas is selected so that a small excess of carbon black is produced. This surplus carbon black is entrained by the scavenging gases and carried into the shaft, where it is deposited on the lumps of coke. If the process is properly controlled, small amounts of coke will be found in some areas on the finished coke. It is not an object of the process according to the invention to produce a protective covering on each lump of coke.

If the carbonaceous material is supplied in the form of dust, it may be desirable to provide open-bottomed grates, e.g., in the form of the rooflike inlets 6 for introducing the hot scavenging gases into the charge. In this case, ash particles or only partly gasified dust cannot deposit in the grate.

The scrubber 13 serves to remove $CO_2$ with the aid of suitable liquids, such as Alkazid process liquor or ethanolamine. The scrubber 14 serves to reduce the dew point by sprinkling with cooled water at, e.g., 4°–5° C. These scrubbers are not normally required.

The diagram in FIG. 1 may be modified in various respects. For instance, the preheating of the gas or air may be omitted or effected by othr means. Scrubbers may be used at different locations. These and other modifications may be adopted without departing from the invention. The process according to the invention may be basically applied also to the coking of fine-grained fuel.

DESCRIPTION

The dust which is deposited in the collecting duct for the coking gas and/or the dust which has been removed from the coking gas by a cyclone are or is preferably added to the hot scavenging gas.

Another dustlike fuel may be used as a reactive carbonaceous material. Fuels having a high reactivity are particularly suitable. Very fine dust is better than a coarse one.

In experiments it has surprisingly been found that the same result can be obtained if high-hydrocarbon gases, particularly natural gas rather than fuel dust, are added to the hot scavenging gas. For this reason the invention covers also the addition of such gases.

It has been found that the carbon black which is released as a result of the cracking of the methane or higher hydrocarbons is sufficiently active in statu nascendi to react to a sufficient extent with the gasifying agents in the scavenging gas in the pregasification passage.

The reaction time is 0.2–2 seconds. This reaction time is sufficient to anticipate in the pregasification passage to a sufficient extent the gasification which is undesired in the coke bed. Fuel dust and/or hydrocarbon rich gases are suitably preheated before they are introduced into the pregasification passage.

The burner and recycle gas required to produce the scavenging gas and/or the air supplied to the burner are also suitably preheated. This measure reduces the firing requirements and may be desirably accomplished by a direct and indirect heat exchange in conjunction with the cooling of the coke.

In accordance with the invention, the dustlike and/or gaseous fuel by which the gasification potential represented by the $CO_2$ and water vapor contents of the heated scavenging gas is consumed is introduced into the hot gas conduits or hot gas ducts which conduct the heated scavenging gas from the combustion chamber to the coking zone. Because the residence time of the gasification reaction is less than two seconds, these conduits are of sufficient length to serve as a pregasification passage.

The process according to the invention is particularly suitable for a coking of briquettes or pellets to produce shaped coke bodies for use in a blast furnace. Such shaped fuel bodies are preferably produced from fine-grained coke and fine-grained coking coal by known hot-briquetting or hot-pelletizing processes. These shaped fuel bodies are a considerably pre-degasified material to be coked and contain only about 6–14% volatile constituents so that they release only a small amount of hydrocarbons during the coking treatment. Those hydrocarbons which remain in the coking gas after the condensation of tar will not be sufficient to form cracked carbon black in the combustion chamber and the hot gas ducts and to consume $CO_2$ and water vapor, and the gasifying agents will remain undecomposed to a large extent, unless the measures according to the invention are adopted.

The scavenging gas will contain much $CO_2$ from the degasification process if a high-oxygen fuel is coked. That scavenging gas will contain a large amount of water vapor unless the coking gas is sufficiently cooled in the final stage of the condensing plant. The higher the proportion of gasifying agents in the scavenging gas, the larger will be the temperature drop caused in the scavenging gas by gasification reactions, whether these take place before or in the coke bed. Particularly with highly reactive coke, this fact may prevent the attaining of the desired high coking temperature. For this reason it is another feature of the invention to remove in such cases the gasifying agents from the coking gas before the latter is used to produce scavenging gas. Carbon dioxide is suitably removed by scrubbing with suitable liquids, and water vapor is suitably removed in that the gas is cooled further to a temperature below 15° C., preferably below 10° C. This may be accomplished, if desired, with the aid of a refrigerator. As a result, the extent of the endothermic reactions caused by the gasifying agents carbon dioxide and water vapor is reduced in the pregasification passage and the temperature of the scavenging gas need not be so highly in excess of the final coking temperature.

What is claimed is:

1. Coking process for converting shaped fuel bodies into shaped coke bodies having high mechanical strength, said shaped fuel bodies containing about 6–14% volatile constituents and being selected from the group consisting of briquettes and pellets made by hot-briquetting or hot-pelletizing fine-grained coke and fine grained caking coal, which comprises:

i. continuously coking said shaped fuel bodies which bodies are at temperatures above 750° C in a shaft oven by direct heating with a hot scavenging gas;

ii. producing said scavenging gas by partial combustion of the coking gas and conducting same upward through the shaft oven countercurrent to the descending shaped fuel bodies;

iii. adding to the hot scavenging gas, before it enters the shaft oven, a reactive material selected from the group consisting of flue dust and high hydrocarbon gases in an amount corresponding to 0.5–3% of the coke throughput; and iv. at least partly consuming gasifying agents carbon dioxide and steam in the hot scavenging gas before it enters the shaft oven by reacting said gasifying agents with said reactive material thereby avoiding detrimental endothermic gasification reactions which would otherwise attack the structure of the shaped coke bodies.

2. Process of claim 1 wherein the reaction time is from 0.2 to 2 seconds.

3. Process of claim 1 wherein the fuel gas and/or the high-hydrocarbon gas are preheated.

4. Process of claim 1 wherein dust removed by sedimentation in the collecting duct for the coking gas and/or the dust removed from the coking gas are used as the reactive material.

5. Process of claim 1 wherein the burner and recycle gases and/or the burner air required for the production of the scavenging gas are preheated.

6. Process of claim 1 wherein the coking gas used to produce the scavenging gas is scrubbed to remove $CO_2$.

7. Process of claim 1 wherein the gas used to produce the scavenging gas is adjusted to a dew point below 15° C.

8. A process of claim 1 wherein the hot scavenging gas together with the residual, ungasified dust is introduced into the shaft oven through open-bottomed grates.

9. Coking process for converting shaped fuel bodies into shaped coke bodies having high mechanical strength, said shaped fuel bodies being selected from the group consisting of briquettes and pellets made by hot-briquetting or hot-pelletizing fine-grained coke and fine-grained caking coal, which comprises:

i. continuously coking said shaped fuel bodies which bodies are at temperatures above 750° C in a shaft oven by direct heating with a hot scavenging gas;

ii. producing said scavenging gas by partial combustion of the coking gas and conducting same upward through the shaft oven countercurrent to the descending shaped fuel bodies;

iii. adding to the hot scavenging gas, before it enters the shaft oven, a reactive material selected from the group consisting of flue dust and high hydrocarbon gases in an amount corresponding to 0.5–3% of the coke throughput; and iv. at least partly consuming gasifying agents carbon dioxide and steam in the hot scavenging gas before it enters the shaft oven by reacting said gasifying agents with said reactive material thereby avoiding detrimental endothermic gasification reactions which would otherwise attach the structure of the shaped coke bodies.

* * * * *